US011826621B2

(12) United States Patent
Pedraza

(10) Patent No.: US 11,826,621 B2
(45) Date of Patent: Nov. 28, 2023

(54) GOLF CLUB

(71) Applicant: Axis1, LLC, Newton, MA (US)

(72) Inventor: Luis Pedraza, West Roxbury, MA (US)

(73) Assignee: Axis1, LLC, Newton, MA (US)

( * ) Notice: Subject to any disclaimer, the term of this patent is extended or adjusted under 35 U.S.C. 154(b) by 0 days.

(21) Appl. No.: 17/525,448

(22) Filed: Nov. 12, 2021

(65) Prior Publication Data

US 2022/0152464 A1 May 19, 2022

Related U.S. Application Data

(60) Provisional application No. 63/113,356, filed on Nov. 13, 2020.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01); *A63B 53/0412* (2020.08)

(58) Field of Classification Search
CPC ..... A63B 53/0487; A63B 53/04
USPC ..... 473/324–350
See application file for complete search history.

(56) References Cited

U.S. PATENT DOCUMENTS 3,637,218 A * 1/1972 Carlino ..... A63B 60/00 473/330
3,817,534 A * 6/1974 Carlino ..... A63B 53/04 473/337
4,898,387 A * 2/1990 Finney ..... A63B 53/0487 473/341
5,060,950 A * 10/1991 Finney ..... A63B 53/0487 473/341
5,131,656 A * 7/1992 Kinoshita ..... A63B 53/0487 473/341
5,632,694 A * 5/1997 Lee ..... A63B 53/04 473/340
5,851,160 A 12/1998 Rugge et al.
6,746,344 B1 * 6/2004 Long ..... A63B 53/0487 473/332
7,331,876 B2 2/2008 Klein
7,407,445 B2 8/2008 Pedraza et al.
(Continued)

FOREIGN PATENT DOCUMENTS

KR 200355029 Y1 * 7/2004 ..... A63B 53/0487
WO WO-2005021104 A2 * 3/2005 ..... A63B 53/0487
(Continued)

OTHER PUBLICATIONS

Feb. 2, 2022—(WO) ISR & WO—App. No. PCT/US2021/059210.

*Primary Examiner* — Alvin A Hunter
(74) *Attorney, Agent, or Firm* — Banner & Witcoff, Ltd.

(57) ABSTRACT

A putter with a putter head that has a rear hollow cavity enclosed within the putter head body to help move the center of gravity forward and a shaft axis that intersects the center of gravity of the putter head within a predetermined range is disclosed. The putter head may have a heel counterweight to move the center of the gravity of the putter head to the desired direction. The hollow cavity in the putter head may extend from a heel region to the toe region of the putter head. In some examples, the hollow cavity may comprise a plurality of hollow cavities or may be a single cavity located in the heel region or the toe region.

19 Claims, 8 Drawing Sheets

(56) References Cited

U.S. PATENT DOCUMENTS

| | | | | |
|---|---|---|---|---|
| 7,491,135 | B1 * | 2/2009 | Rollinson | A63B 60/54 473/342 |
| D592,716 | S | 5/2009 | Pedraza | |
| 7,722,476 | B2 | 5/2010 | Pedraza et al. | |
| 7,857,710 | B2 | 12/2010 | Pedraza | |
| 8,016,693 | B2 | 9/2011 | Pedraza | |
| 9,144,723 | B2 | 9/2015 | Touchette | |
| 2004/0058743 | A1 * | 3/2004 | Hettinger | A63B 53/0487 473/340 |
| 2004/0063516 | A1 * | 4/2004 | Cameron | A63B 53/0487 473/340 |
| 2005/0282656 | A1 * | 12/2005 | Davis | A63B 60/02 473/340 |
| 2006/0068935 | A1 * | 3/2006 | Tang | A63B 60/02 473/340 |
| 2007/0049401 | A1 * | 3/2007 | Tateno | A63B 53/0487 473/340 |
| 2007/0117651 | A1 * | 5/2007 | Belmont | A63B 53/0466 473/349 |
| 2007/0135232 | A1 * | 6/2007 | Billings | A63B 53/0487 473/340 |
| 2007/0149317 | A1 * | 6/2007 | Kubota | A63B 53/0487 473/340 |
| 2007/0191137 | A1 * | 8/2007 | Nishino | A63B 53/04 473/340 |
| 2007/0293346 | A1 * | 12/2007 | Rollinson | A63B 53/12 473/340 |
| 2008/0146371 | A1 * | 6/2008 | Wahl | A63B 53/0487 473/340 |
| 2012/0289360 | A1 * | 11/2012 | Breier | A63B 53/047 473/335 |
| 2013/0005499 | A1 * | 1/2013 | Cameron | A63B 69/3685 473/314 |
| 2016/0129321 | A1 * | 5/2016 | Dolezel | A63B 53/0487 473/340 |
| 2020/0101357 | A1 * | 4/2020 | Higdon | A63B 53/065 |
| 2021/0245020 | A1 * | 8/2021 | Higdon | A63B 53/0487 |
| 2022/0152464 | A1 * | 5/2022 | Pedraza | A63B 53/0412 |

FOREIGN PATENT DOCUMENTS

| | | | | |
|---|---|---|---|---|
| WO | 2016160455 | A1 | 10/2016 | |
| WO | WO-2022104115 | A1 * | 5/2022 | A63B 53/007 |

* cited by examiner

GOLF CLUB

CROSS-REFERENCE TO RELATED MATTERS

This application claims priority to U.S. Application No. 63/113,356 filed on Nov. 13, 2020. The above referenced application is incorporated by reference in its entirety.

FIELD

Aspects of this disclosure relate to golf club, in particular a putter.

BACKGROUND

The game of golf may be challenging to many golfers. Many golf clubs are arranged to assist golfers to make the game easier. A putter design can have improved overall forgiveness and performance by optimizing the mass properties of the club head and the club head's relationship with the shaft, which can help make the game more enjoyable for golfers.

Particular objects and advantages will be apparent to those skilled in the art, that is, those who are knowledgeable or experienced in this field of technology, in view of the following disclosure and detailed description of certain examples.

SUMMARY

The disclosure may relates a golf club comprising: a club head with a club head body having a front side, a rear side opposite the front side, a top side, a bottom side opposite the top side, a toe side, and a heel side opposite the toe side, where the club head body includes: (a) a ball-striking face with a lower edge defining a leading edge of the club head and an upper edge opposite the lower edge; (b) a sole surface extending rearward from the leading edge with a trailing edge opposite the leading edge; (c) a hollow cavity enclosed within the club head body; (d) a hosel located on the heel side. The golf club further includes a shaft may be attached to the hosel, where the shaft defines a shaft axis. The center of gravity of the club head may be within a range of +/−4 mm in a front-to rear direction, a heel-to-toe direction, and a top-to-bottom direction of an intersection of the shaft axis and a center plane of the club head.

Additional aspects of this disclosure may relate to a golf club that comprises: a club head with a club head body that includes a front side, a rear side opposite the front side, a top side, a bottom side opposite the top side, a toe side, and a heel side opposite the toe side, where the club head body includes: (a) a ball-striking face with a lower edge defining a leading edge of the club head and an upper edge opposite the lower edge; (b) a sole surface extending rearward from the leading edge with a trailing edge opposite the leading edge; (c) a hollow cavity enclosed within the club head body; and (d) a hosel located on the heel side. A shaft attached to the hosel of the club head, where the shaft defines a shaft axis. The center of gravity of the club head may be within a range of +/−4 mm in a front-to rear direction, a heel-to-toe direction, and a top-to-bottom direction of an intersection of the shaft axis and a center plane of the club head. The club head body may include an upper surface that extends from the upper edge of the ball-striking face and a shelf member located below the upper surface and above the sole surface. The hollow cavity may have a portion that extends between the shelf member and the sole surface, where a heel portion of the hollow cavity may have a first volume that is greater than a second volume of a toe portion of the hollow cavity. In some examples, the club head body may be formed as a unitary member. In other examples, the club head body may include a heel counterweight region that is forward of the striking face, where the heel counterweight region may have a weight that is within 10 percent and 25 percent of an overall weight of the club head. An overall weight of the club head is within a range of 330 grams and 390 grams. A breadth of the club head body may be within a range of within a range of 3.2 centimeters (cm) and 4.4 cm, where the breadth is defined as a distance from the leading edge to the trailing edge. The golf club may be a putter.

Still other aspects of this disclosure may relate to a putter head comprising a putter head body that includes a front side, a rear side opposite the front side, a top side, a bottom side opposite the top side, a toe side, and a heel side opposite the toe side, where the putter head body includes: (a) a planar ball-striking face with a lower edge that defines a leading edge of the putter head and an upper edge opposite the lower edge; (b) a sole surface that extends rearward from the leading edge with a trailing edge opposite the leading edge; (c) an asymmetric hollow cavity enclosed within the putter head body, where a first portion of the hollow cavity is located in a heel portion of the putter head and a second portion of the hollow cavity is located in a toe portion of the putter head with the first portion having a first volume that is greater than a second volume of the second portion; and (d) a hosel located on the heel side of the putter head body. An overall weight of the putter head may be within a range of 330 grams and 390 grams, and a loft angle of the putter head may be within a range of 0 and 6 degrees. In addition, an overall volume of the putter head may be within a range of 57 cubic centimeters (cc) and 85 cc. A breadth of the putter head body may be within a range of within a range of 3.2 cm and 4.4 cm, where the breadth may be defined as a distance from the leading edge to the trailing edge. The putter head may be attached to a shaft to form a putter, where a center of gravity of the putter head may be within a range of +/−4 mm in a front-to rear direction, a heel-to-toe direction, and a top-to-bottom direction of an intersection of a shaft axis and a center plane of the putter head. The putter head may be attached to a shaft forming a putter, where a center of gravity of the putter head is within a range of +/−2 mm in a front-to rear direction, a heel-to-toe direction, and a top-to-bottom direction of an intersection of a shaft axis and a center plane of the putter head. The hollow cavity may have a volume within a range of 24 percent and 50 percent of the overall volume of the putter head, where the first volume may be within a range of 1.2 times and 2.3 times greater than the second volume.

Still other aspects of this disclosure may relate to a putter head comprising a putter head body that includes a front side, a rear side opposite the front side, a top side, a bottom side opposite the top side, a toe side, and a heel side opposite the toe side, where the putter head body includes: (a) a ball-striking face with a lower edge that defines a leading edge of the putter head and an upper edge opposite the lower edge; (b) a sole surface that extends rearward from the leading edge with a trailing edge opposite the leading edge; (c) a first hollow cavity that is enclosed within the putter head body located in a heel portion of the putter head; (d) a second hollow cavity that is enclosed within the putter head body located in a toe portion of the putter head, wherein the first hollow cavity and the second hollow cavity are separated from each other; and (e) a hosel located on the heel side of the putter head body. An overall weight of the putter head may be within a range of 330 grams and 390 grams, and a loft angle of the putter head may be within a range of 0 and 6 degrees. An overall volume of the putter head may be within a range of 57 cubic centimeters (cc) and 85 cc. The putter head may be attached to a shaft forming a putter, where a center of gravity of the putter head is within a range of +/−4 mm in a front-to rear direction, a heel-to-toe direction, and a top-to-bottom direction of an intersection of a shaft axis and a center plane of the putter head. The putter head may also have a breadth of the putter head body is within a range of within a range of 3.2 cm and 4.4 cm, wherein the breadth is defined as a distance from the leading edge to the trailing edge. In some examples, the first hollow cavity in the heel portion may have a greater volume than the second hollow cavity in the toe portion.

These and additional features and advantages disclosed here will be further understood from the following detailed disclosure of certain examples, the drawings thereof, and from the claims.

BRIEF DESCRIPTION OF THE DRAWINGS

The foregoing and other features and advantages of the present examples will be more fully understood from the following detailed description of illustrative examples taken in conjunction with the accompanying drawings in which.

Figure 1:
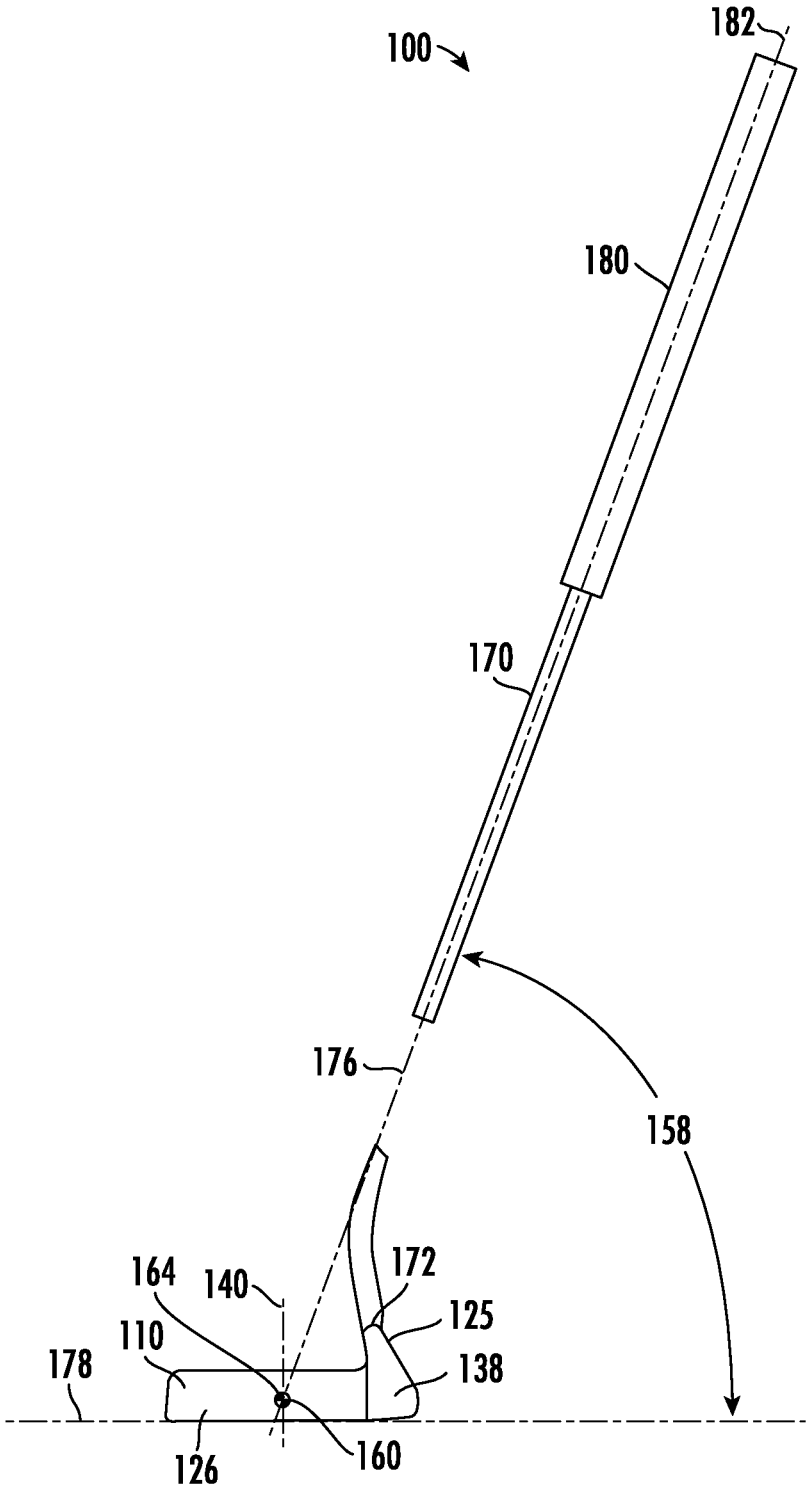
FIG. 1 illustrates a front view of an exemplary golf club according to aspects described herein.

The figures referred to above are not drawn necessarily to scale, should be understood to provide a representation of particular examples, and are merely conceptual in nature and illustrative of the principles involved. Some features of the golf club or club head depicted in the drawings have been enlarged or distorted relative to others to facilitate explanation and understanding. The same reference numbers are used in the drawings for similar or identical components and features shown in various alternative examples.

DETAILED DESCRIPTION

In general, this disclosure relates to a golf club, in particular a putter with a club head that includes a hollow portion, where the center of gravity (CG) is located with a predetermined range of an intersection of the shaft axis and the center of the ball-striking face.

In general, this disclosure relates to a golf club, in particular a putter, with a club head that includes a hollow cavity that helps to move the center of gravity forward, as compared to a solid club head, to align the center of gravity with the axis of the shaft.

The term "substantially" as used herein is meant to mean mostly, or almost completely, within the constraints of sensible commercial engineering objectives, costs, manufacturing tolerances, and capabilities in the field of golf clubs. Similarly, the term "approximately" as used herein is meant to mean close to, or about a particular value, within the constraints of sensible commercial engineering objectives, costs, manufacturing tolerances, and capabilities in the field of golf clubs.

FIG. 1 illustrates an exemplary golf club 100 as described herein. The golf club 100 may have a golf club head 110, a shaft 170 that connects to a hosel portion 125 (e.g., the stem of the putter head) at a first end 172 of the shaft 170 of the golf club head 110, and a grip member 180 that is attached to a second end of the shaft 170 located under the grip member 180. The shaft 170 may define a shaft axis 176 that extends along a portion of the shaft 170 that defines a majority of the length of the shaft 170. The shaft axis 176 may also extend parallel to and be collinear with a grip axis 182 defined by the receiver of the grip member 180 that engages the shaft 170. The exemplary golf club head 110 is a putter head.

As shown in FIGS. 2-10, the golf club head 110 may have a club head body 112 with a front side 114, a rear side 116 opposite the front side 114, a toe side 118, a heel side 120 opposite the toe side 118, a top side 122 that is visual to user at an address position, and a sole side 124 opposite the top side 122. The hosel portion 125 may be located on the heel side 120 of the club head body 112. The shaft axis 176 may define a lie angle 158 of the club head as defined as the angle from the ground plane 178. A club head center plane 140 may be defined as a plane that is perpendicular to the ground plane 178, perpendicular to a plane that defines a face angle of zero degrees (0°), and located at a midpoint of the ball-striking face 126, where the midpoint of the ball-striking face may be defined as the midpoint between the furthest point on the toe side 118 of the ball-striking face 126 and the furthest point of the heel side 120 of the ball-striking face 126. In addition, the club head 110 may have a heel portion 142 that is defined as the portion of the club head body 112 heelward of the center plane 140 and the toe portion 144 that is defined as the portion of the club head body 112 toeward of the center plane 140.

The club head body 112 may include ball-striking face 126 on the front side 114 that is configured to strike a golf ball, where the ball-striking face 126 may have a lower edge 128 that defines a leading edge of the club head 110 and an upper edge 130 of the ball-striking face 126. A sole member 132 of the club head body 112 may extend rearward from the leading edge 128 along the sole side 124 to a trailing edge 134 of the club head body 112, where the trailing edge 134 may be located opposite the leading edge 128. The hosel portion 125 may be attached to and located forward of the ball-striking face 126 of the club head body 112. In some examples, a heel counterweight 138 may be located forward of the ball-striking face 126 where the hosel portion 125 may be connected to the heel counterweight 138.

Figure 11:
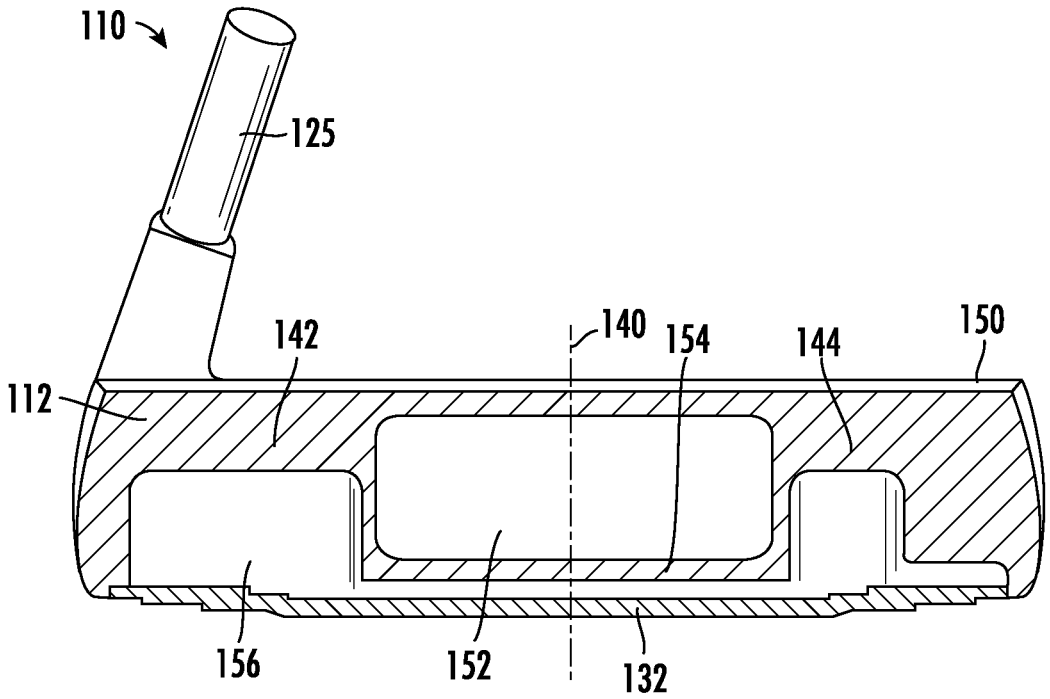
FIG. 11 illustrates a cross-sectional view rear cross-sectional view of the exemplary golf club head along line 11-11 of FIG. 7 according to aspects described herein.
Figure 12:
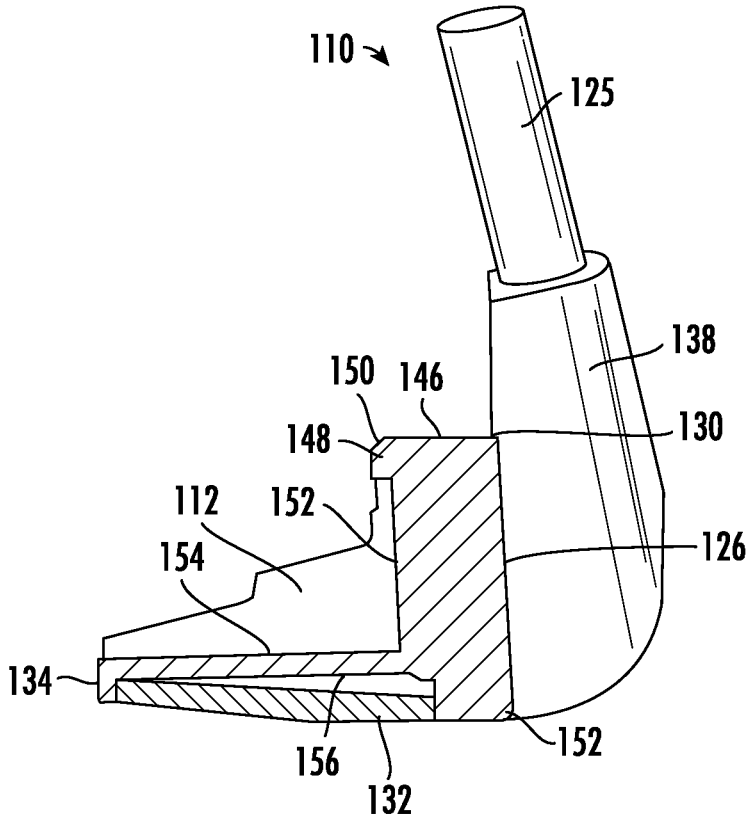
FIG. 12 illustrates a cross-sectional view side cross-sectional view of the exemplary golf club head along line 12-12 of FIG. 7 according to aspects described herein.

In addition, the club head body 112 may have an upper surface 146 that extends rearward from the upper edge 130 of the ball-striking face 126. The upper surface 146 may extend between the heel side 120 to the toe side 118 and extend along a majority of a length, L, of the club head body 112. The club head body 112 may also include a substantially vertical rear-facing surface 148 that extends downward from a rear edge 150 of the upper surface 146. The rear-facing surface 148 may include a recess 152 or undercut pocket that extends underneath the upper surface 146. A shelf member 154 may be located below the upper surface 146 and may also be located beneath a lower edge of the recess 152. The recess 152 may be substantially centered along the club head center plane 140. The shelf member 154 may extend across the top side 122 of the club head body 112 from the toe side 118 to the heel side 120. In some cases, the shelf member 154 may have multiple tiers or levels. The club head body 112 may further include a hollow cavity 156 that is fully enclosed within the club head body 112. The wall thicknesses of the club head body 112 around the hollow cavity 156 may vary and in some regions, may be within a range 1.5 mm and 3 mm. A portion of the hollow cavity 156 may be located between the shelf member 154 and the sole member 132 as shown in FIG. 12. In some examples, the hollow cavity 156 may extend into both the heel portion 142 and the toe portion 144. The hollow cavity 156 may have an asymmetric shape such that the shape of the portion of the hollow cavity 156 in the heel portion 142 is different than the shape of the portion of the hollow cavity 156 in the toe portion 144. As shown in FIG. 11 of the illustrated example, the hollow cavity 156 may have a larger volume in the heel portion 142, than in the toe portion 144. In some examples, the portion of the hollow cavity 156 in the heel portion 142 may have a volume that approximately 60 percent of the volume of the hollow cavity 156, or within a range of 55 percent and 70 percent of the volume of the hollow cavity 156. In other words, the volume of the heel portion 142 may approximately 1.6 times greater than a volume of the hollow cavity 156 in the toe portion 144, or the volume of the heel portion 142 may be within a range of 1.2 to 2.3 times greater than a volume of the hollow cavity 156 in the toe portion 144. In some examples, the hollow cavity 156 may comprise a plurality of cavities that are fully enclosed within either a heel portion 142 or a toe portion 144. For example, the hollow cavity 156 may comprise a first cavity 157A fully enclosed in the heel portion 142 and a second cavity 157B fully enclosed in the toe portion 144 that are not in communication with each other across the center plane 140 as shown in FIG. 14. As another example, the hollow cavity 156 may comprise multiple hollow cavities in of the heel portion 142 and multiple cavities in the toe portion 144, such that a first hollow cavity may be in the heel portion 142 and a second hollow cavity may be in the toe portion 144, wherein the two hollow cavities are separated. Similar to the illustrated example, the first hollow cavity in the heel portion 142 may have a greater volume than the second hollow cavity in the toe portion 144. Alternatively, the hollow cavity 156 may be a single cavity located in either the heel portion 142 or the toe portion 144. The overall volume of the club head 110 may be within a range 55 cubic centimeters (cc) and 100 cc, or may be within a range of 57 cc and 85 cc, or may be within a range of 59 cc and 76 cc. Optionally, the overall volume may be outside of the above referenced ranges. In the illustrative example, the hollow cavity 156 may have a volume of approximately 15.5 cc, or in some examples, the hollow cavity 156 may have a volume within a range of 12 cc and 30 cc. The overall volume of the club head 100 may be measured by a water displacement method as known to one skilled in the art. Another way of expressing the volume of the hollow cavity 156 may be as a percentage of the overall volume of the club head 110. For example, the hollow cavity 156 may have a volume within a range of 35 percent and 60 percent of the overall volume of the club head 110, or in some examples, the hollow cavity 156 may have a volume within a range of 24 percent and 50 percent of the overall volume of the club head 110. Optionally, in some examples, the hollow cavity 156 may have an external opening or plurality of openings (not shown) that extend through the sole member such that the hollow cavity 156 is not fully enclosed by the club head body 112.

Figure 2:
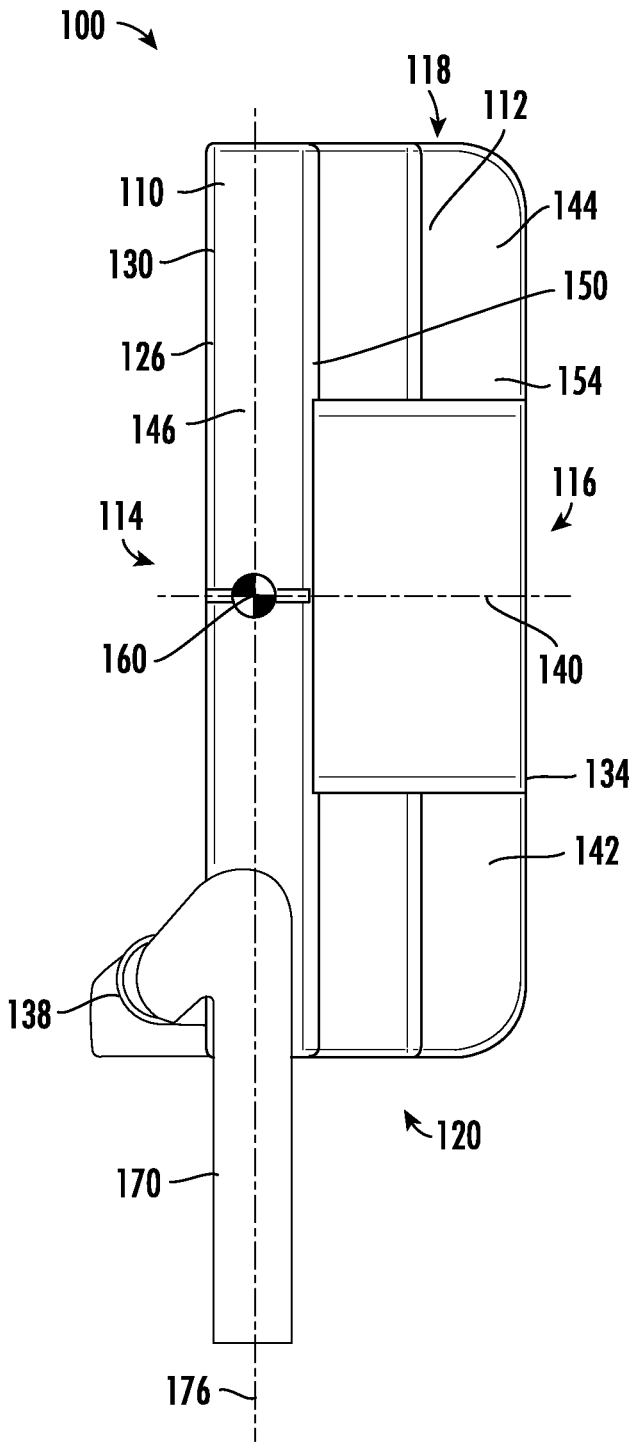
FIG. 2 illustrates a portion of a top view of the exemplary golf club of FIG. 1 according to aspects described herein.
Figure 3:
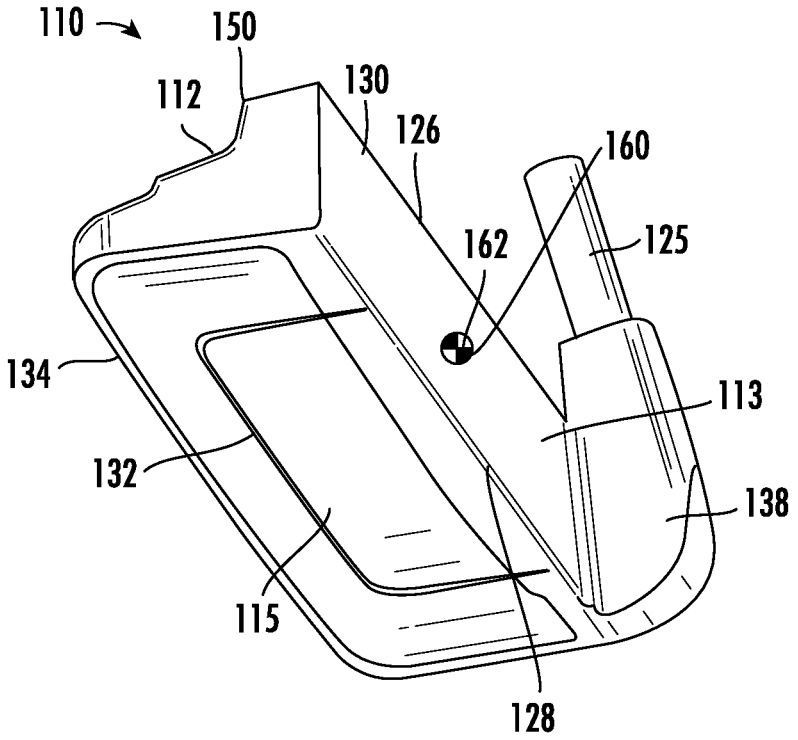
FIG. 3 illustrates a lower front perspective view of the exemplary golf club head of the golf club of FIG. 1 according to aspects described herein.
Figure 4:
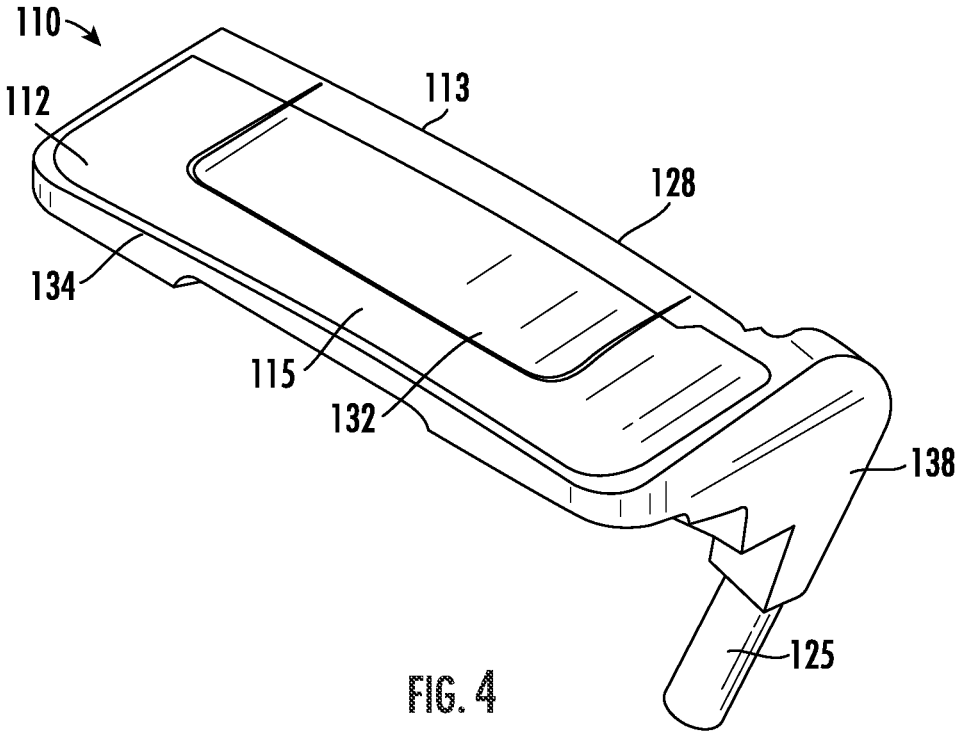
FIG. 4 illustrates a lower rear perspective view of the exemplary golf club head of FIG. 3 according to aspects described herein.
Figure 5:
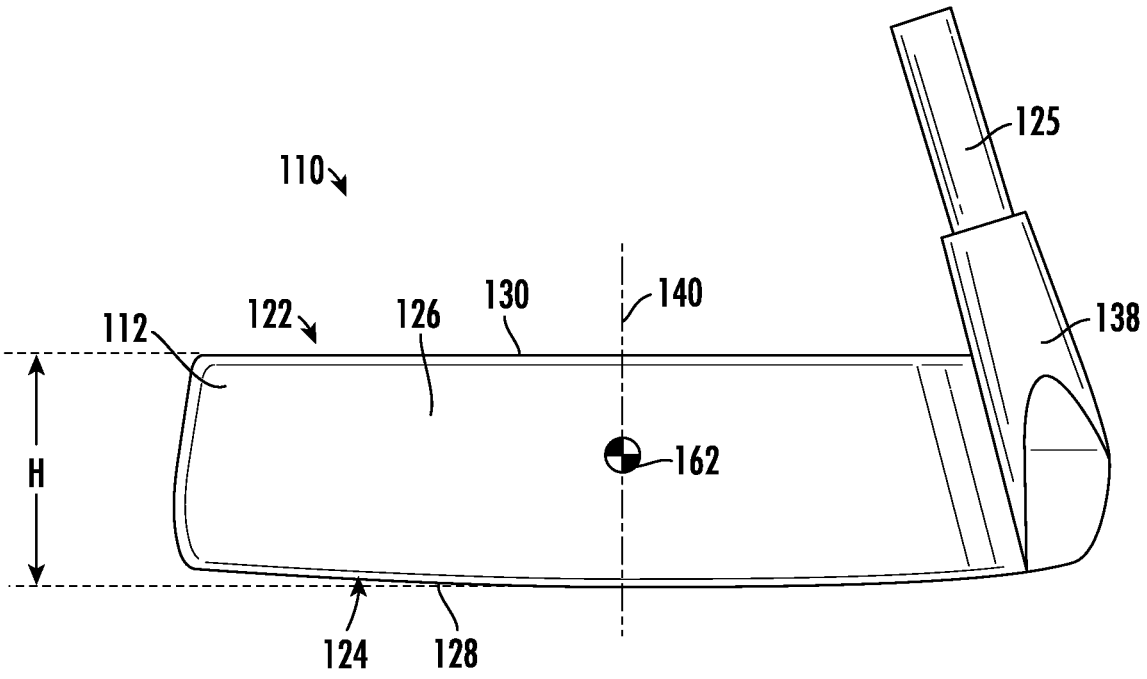
FIG. 5 illustrates a front view of the exemplary golf club head of FIG. 3 according to aspects described herein.
Figure 6:
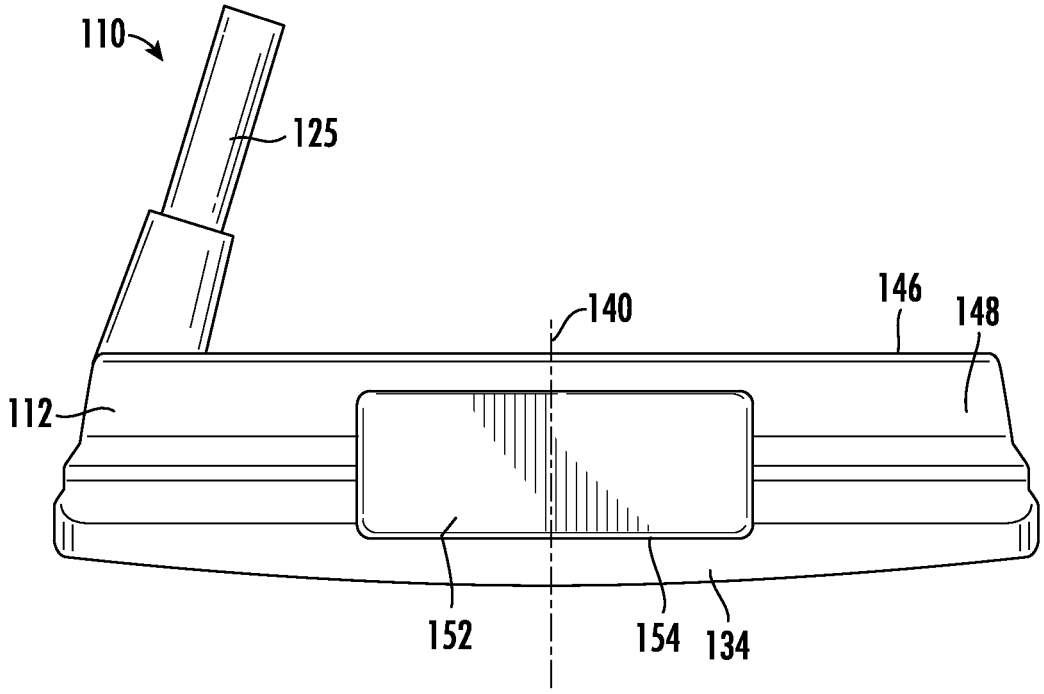
FIG. 6 illustrates a rear view of the exemplary golf club head of FIG. 3 according to aspects described herein.
Figure 7:
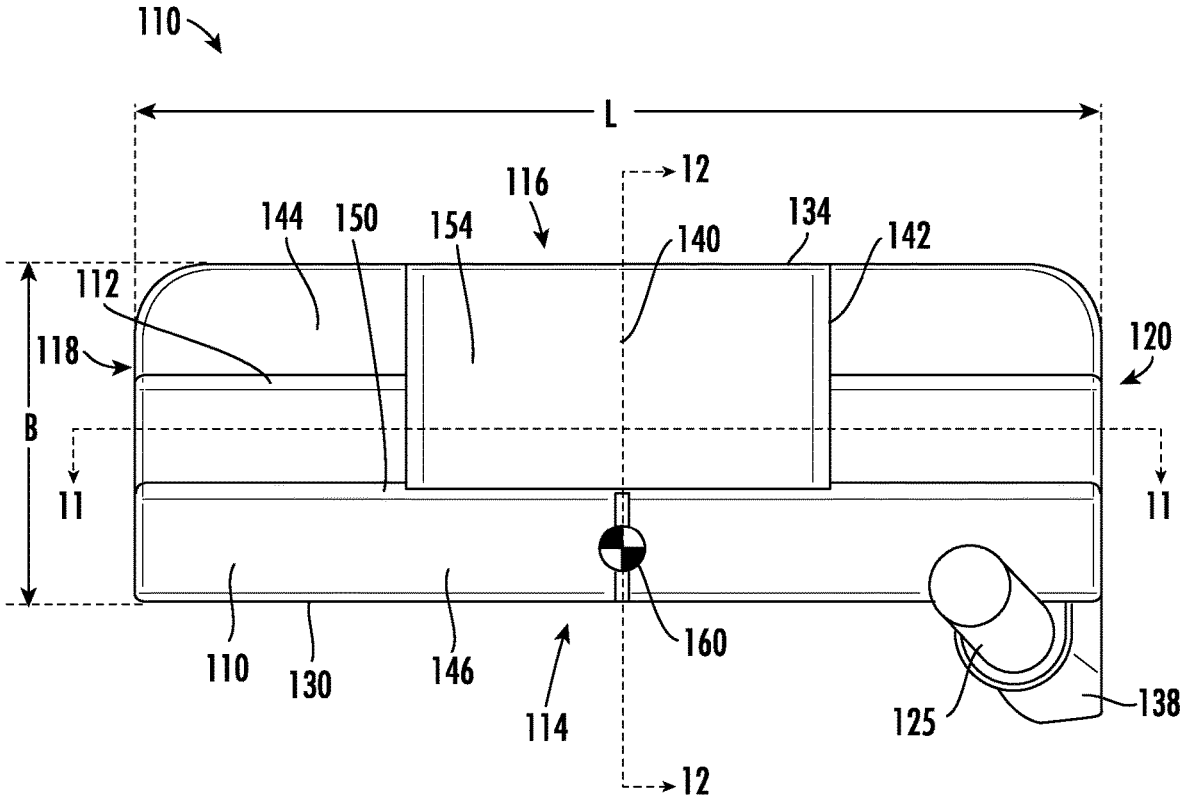
FIG. 7 illustrates a top view of the exemplary golf club head of FIG. 3 according to aspects described herein.
Figure 8:
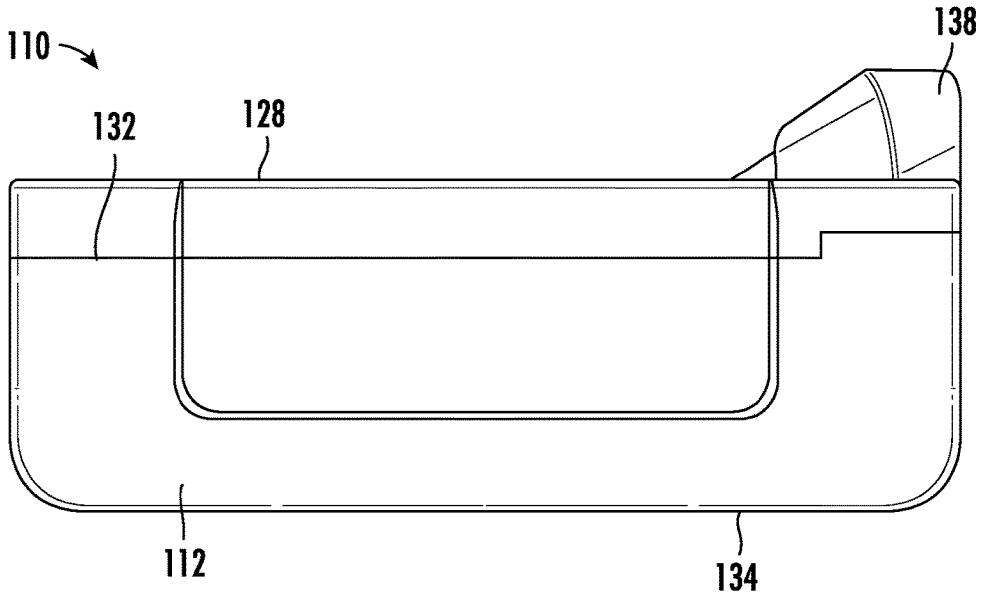
FIG. 8 illustrates a bottom view of the exemplary golf club head of FIG. 3 according to aspects described herein.
Figure 9:
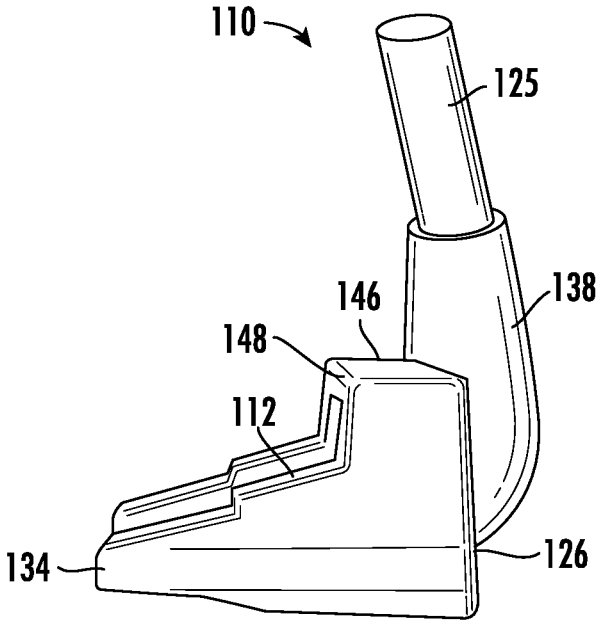
FIG. 9 illustrates a toe side perspective view of the exemplary golf club head of FIG. 3 according to aspects described herein.
Figure 10:
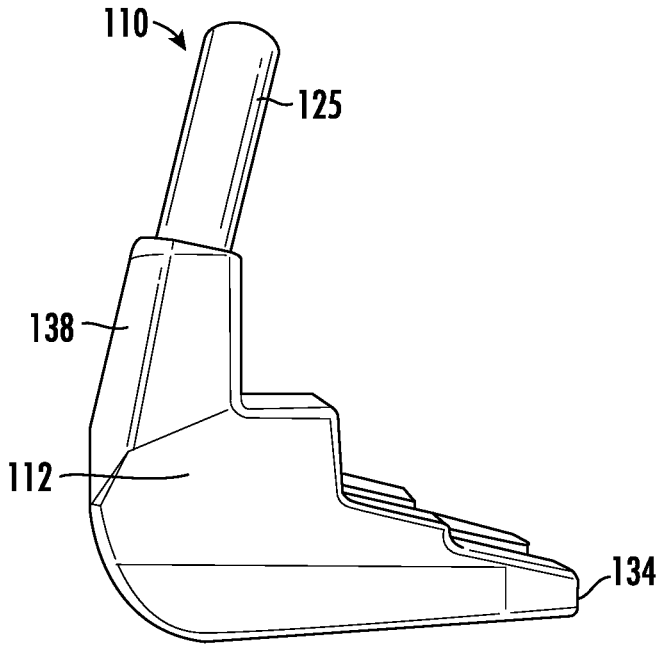
FIG. 10 illustrates a heel side perspective view of the exemplary golf club head of FIG. 3 according to aspects described herein.

The putter head 110 may have mass properties to enable the putter to significantly reduce the torque felt by a user during a putting stroke. The center of gravity 160 of the putter head 110 may provide the putter 100 with the proper performance to reduce the spin induced on the golf ball during impact while also providing a solid feel. In addition, the combination of the mass properties of putter head 110 along with the CG location being aligned with the axis of the shaft may enable the putter to eliminate the torque normally felt with typical putters when striking the ball. As shown in FIGS. 1 and 2, the center of gravity 160 of the putter head 110 may be located at an intersection 164 of the shaft axis 176 and the center plane 140, or the center of gravity 160 may be located within a range of +/−2 mm of the intersection 164 in a front-to-rear direction, a heel-to-toe direction, and a top-to-bottom direction, or within a range of +/−4 mm of the intersection 164 in a front-to-rear direction, a heel-to-toe direction, and a top-to-bottom direction. The center of gravity 160 of the putter head 110 may be located along the center plane 140 of the putter head 110, or within +/−2 mm of the center plane 140, or within +/−4 mm of the center plane 140. In some examples, the center of gravity 160 may be located at a center point 162 of the ball-striking face 126, or within a range of +/−2 mm in a top-to-bottom direction and within a range of +/−2 mm in a front-to-rear direction, or in some examples, the center of gravity 160 may be within a range of +/−4 mm in a top-to-bottom direction and within a range of +/−4 mm in a front-to-rear direction. In some cases, the center of gravity 160 may be located within 12.7 mm rearward of the center point 162. In other cases, the center of gravity 160 may be located within 6.3 mm rearward of the center point 162. The center point 162 of the ball-striking face 126 may be defined as the midpoint between the leading edge 128 and the upper edge 130 along the center plane 140.

The overall weight of the putter head 110 may be approximately 355 grams, or within a range of 340 grams and 375 grams, or within a range of 330 grams and 390 grams. The heel counterweight 138, which may be defined as the region that is positioned forward of the ball-striking face 126, may help to move the overall center of gravity 160 forward to the desired location. The weight of the heel counterweight region 138 (which includes the hosel portion 125 that attaches to the shaft) may be approximately 14.5 percent of the overall weight of the putter head 110, or within a range of 12 percent and 17 percent of the overall weight, or within a range of 10 percent and 25 percent of the overall weight of the putter head. For example, the heel counterweight region may have a weight of approximately 51.5, or approximately 54.5 grams, or within a range of may be within a range of 50 grams and 60 grams, or within a range of 40 grams and 90 grams. As another feature, when considering the club head 110 without the heel counterweight region 138, the weight of the toe portion 144 of the club head 110 may be greater than the weight of the heel portion 142 of the club head 110.

In addition, the putter head 110 may have dimensional ranges that help to provide a center of gravity 160 in the desired location. For instance, the overall length, L, from a further most point on the toe side 118 to a furthermost point on the heel side 120 may be approximately 10.8 cm (4.25 inches), or approximately 11.4 cm (4.5 inches) or within a range of 9 cm (3.54 inches) and 12.7 cm (5.0 inches). The overall height, H, defined as a distance from a bottom most point of the sole member 132 to an upper most point of the putter head 110 at the ball-striking face 126 or rearward of the ball-striking face 126 (i.e. excluding the hosel portion 125 and the heel counterweight region 138 may be within a range of 2.54 cm (1.0 inches), or within a range of 1.9 cm (0.75 inches) and 3.2 cm (1.25 inches). The overall breadth, B, defined as a distance from the leading edge 128 to the trailing edge 134 of the putter head 110 may be approximately 3.8 cm (1.5 inches), or within a range of 3.2 cm (1.25 inches) and 4.4 cm (1.75 inches). In some examples, the breadth may be within a range of 3.8 cm (1.5 inches) and 10.8 cm (4.25 inches). With the breadth of the putter head 110 being greater than 3.2 cm, the putter head 110 may have higher moments of inertia (compared to putters with a smaller breadth) about both a vertical (top-to-bottom) axis and a horizontal (heel-to-toe) axis, where the axes extend through the center of gravity 160. Optionally, the breadth of the putter head 110 may be expressed as a percentage of the length of the putter head 110. The breadth of the putter head 110 may be less than the length of the putter head and may be within a range of 70 percent of the length and 99 percent of the length. This increased moment of inertia can improve the overall forgiveness of the putter head 110 on off-center impacts. The breadth, B, may also provide a platform for an alignment aid that could be located on the shelf member 154 or the upper surface 146, or in some cases located on both the shelf member 154 and the upper surface 146. In other examples, the putter head 110 may be outside of the ranges above.

The ball-striking face 126 may be planar and may have a loft angle within a range of 0 degrees and 4 degrees, or within a range of 0 degrees 6 degrees. As known to one skilled in the art, the loft angle may be defined as the angle between the ball-striking face 126 and a vertical plane.

Additionally, the golf club head 110 may be formed from a plurality of components. For instance, the club head body 112 may be formed from a first member 113 that includes the ball-striking face 126, the upper surface 146, the shelf member 154, and a portion of the sole member 132 and a second member 115 that forms a portion of the sole member 132. The two components 113, 115 may be permanently joined together to present a single unibody structure and to enclose the hollow cavity 156. In some examples, the two components 113, 115 may be joined using a welding technique, such as plasma or laser welding, or may be joined using an adhesive, brazing, or other permanent joining methods known to one skilled in the art. In some examples, the club head body 112 may be formed as a single unitary member using an additive manufacturing or 3D printing process. In addition, in some examples, the hollow cavity 156 formed within the club head body 112 may include a honeycomb or lattice structure to help support the outer structure of the club head body 112. The club head 110 may be formed from a metallic material, such as a steel alloy, where the density of the club head 110 may be within a range of 7.75 g/cc and 8.05 g/cc. In some examples, the components that form the club head 110 may be made of different materials with different densities. In other examples, the club head 110 may be formed from an aluminum or magnesium alloy.

Figure 13:
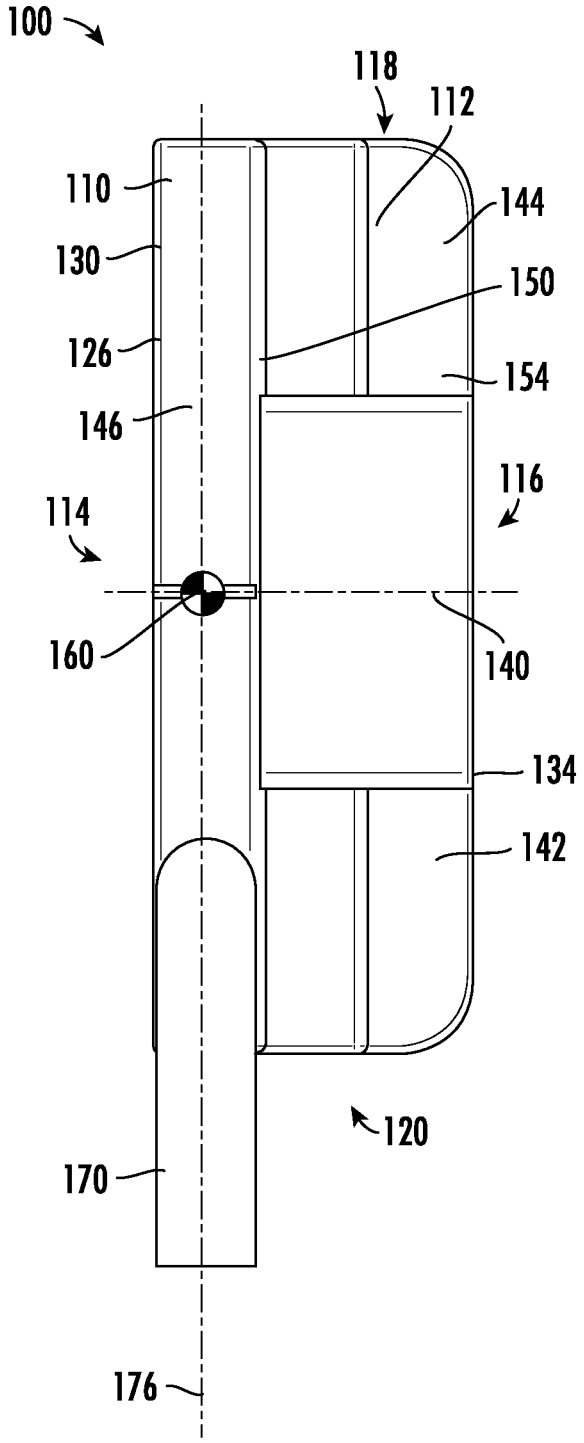
FIG. 13 illustrates a top view of another exemplary golf club according to aspects described herein.

Alternatively or optionally, as shown in FIG. 13, the putter head 110 may be formed without the heel counterweight 138 while still having the dimensional and mass properties described above. For instance, the putter head 110 may be formed with a hollow cavity 156 and as described above have a shaft axis 176 that intersects a center of gravity 160 of the putter head 110. The club head body 112 may include high-density inserts located on or near the ball-striking face to locate the center of gravity 160 to the ranges described above. The high-density inserts may include tungsten and may have a density within a range of 10 g/cc and 17 g/cc.

Those having skill in the art, with the knowledge gained from the present disclosure, will recognize that various changes can be made to the disclosed apparatuses and methods in attaining these and other advantages, without departing from the scope of the present invention. As such, it should be understood that the features described herein are susceptible to modification, alteration, changes, or substitution. For example, it is expressly intended that all combinations of those elements and/or steps, which perform substantially the same function, in substantially the same way, to achieve the same results, is within the scope of the invention. Substitutions of elements from one described example to another are also fully intended and contemplated. The specific examples illustrated and described herein are for illustrative purposes only, and not limiting of the invention as set forth in the appended claims. Other examples will be evident to those of skill in the art. It should be understood that the foregoing description is provided for clarity only and is merely exemplary. The spirit and scope of the present invention are not limited to the above examples, but are encompassed by the following claims.

I claim:

1. A golf club comprising:

a club head with a club head body that includes a front side, a rear side opposite the front side, a top side, a bottom side opposite the top side, a toe side, and a heel side opposite the toe side, the club head body including:

a ball-striking face with a lower edge defining a leading edge of the club head and an upper edge opposite the lower edge;

a sole surface extending rearward from the leading edge with a trailing edge opposite the leading edge;

an upper surface that extends from the upper edge of the ball-striking face and a shelf member located below the upper surface and above the sole surface;

a hollow cavity enclosed within the club head body;

wherein a heel portion of the hollow cavity has a first volume that is greater than a second volume of a toe portion of the hollow cavity;

a hosel located on the heel side; and a shaft attached to the hosel of the club head, wherein the shaft defines a shaft axis; and wherein a center of gravity of the club head is within a range of +/−4 mm in a front-to-rear direction, a heel-to-toe direction, and a top-to-bottom direction of an intersection of the shaft axis and a center plane of the club head.

2. The golf club of claim 1, wherein the hollow cavity has a portion that extends between the shelf member and the sole surface.

3. The golf club of claim 1, wherein the club head body is formed as a unitary member.

4. The golf club of claim 1, wherein the club head body further includes a heel counterweight region that is forward of the striking face.

5. The golf club of claim 4, wherein the heel counterweight region has a weight that is within 10 percent and 25 percent of an overall weight of the club head.

6. The golf club of claim 1, wherein an overall weight of the club head is within a range of 330 grams and 390 grams.

7. The golf club of claim 1, wherein a breadth of the club head body is within a range of 3.2 centimeters (cm) and 4.4 cm, wherein the breadth is defined as a distance from the leading edge to the trailing edge.

8. The golf club of claim 1, wherein the golf club is a putter.

9. The golf club of claim 1, wherein a breadth of the club head body is within a range of 3.8 centimeters (cm) and 10.8 cm, wherein the breadth is defined as a distance from the leading edge to the trailing edge.

10. A putter head comprising:

a putter head body that includes a front side, a rear side opposite the front side, a top side, a bottom side opposite the top side, a toe side, and a heel side opposite the toe side, the putter head body including:

a planar ball-striking face with a lower edge defining a leading edge of the putter head and an upper edge opposite the lower edge;

a sole surface extending rearward from the leading edge with a trailing edge opposite the leading edge;

an asymmetric hollow cavity enclosed within the putter head body, wherein a first portion of the hollow cavity is located in a heel portion of the putter head and a second portion of the hollow cavity is located in a toe portion of the putter head, and the first portion has a first volume that is greater than a second volume of the second portion;

a hosel located on the heel side of the putter head body;

wherein an overall weight of the putter head is within a range of 330 grams and 390 grams and a loft angle of the putter head is within a range of 0 and 6 degrees; and wherein an overall volume of the putter head is within a range of 57 cubic centimeters (cc) and 76 cc.

11. The putter head of claim 10, wherein a breadth of the putter head body is within a range of 3.2 cm and 4.4 cm, wherein the breadth is defined as a distance from the leading edge to the trailing edge.

12. The putter head of claim 10, wherein the putter head is attached to a shaft forming a putter, and wherein a center of gravity of the putter head is within a range of +/−4 mm in a front-to rear direction, a heel-to-toe direction, and a top-to-bottom direction of an intersection of a shaft axis and a center plane of the putter head.

13. The putter head of claim 10, wherein the putter head is attached to a shaft forming a putter, and wherein a center of gravity of the putter head is within a range of +/−2 mm in a front-to rear direction, a heel-to-toe direction, and a top-to-bottom direction of an intersection of a shaft axis and a center plane of the putter head.

14. The putter head of claim 10, wherein the hollow cavity has a volume within a range of 24 percent and 50 percent of the overall volume of the putter head.

15. The putter head of claim 10, wherein the first volume is within a range of 1.2 times and 2.3 times greater than the second volume.

16. A putter head comprising:

a putter head body that includes a front side, a rear side opposite the front side, a top side, a bottom side opposite the top side, a toe side, and a heel side opposite the toe side, the putter head body including:

a ball-striking face with a lower edge defining a leading edge of the putter head and an upper edge opposite the lower edge;

a sole surface extending rearward from the leading edge with a trailing edge opposite the leading edge;

a first hollow cavity enclosed within the putter head body located in a heel portion of the putter head;

a second hollow cavity enclosed within the putter head body located in a toe portion of the putter head, wherein the first hollow cavity and the second hollow cavity are separated from each other;

a hosel located on the heel side of the putter head body;

wherein an overall weight of the putter head is within a range of 330 grams and 390 grams and a loft angle of the putter head is within a range of 0 and 6 degrees; and wherein an overall volume of the putter head is within a range of 57 cubic centimeters (cc) and 85 cc.

17. The putter head of claim 16, wherein the putter head is attached to a shaft forming a putter, and wherein a center of gravity of the putter head is within a range of +/−4 mm in a front-to rear direction, a heel-to-toe direction, and a top-to-bottom direction of an intersection of a shaft axis and a center plane of the putter head.

18. The putter head of claim 16, wherein a breadth of the putter head body is within a range of 3.2 cm and 4.4 cm, wherein the breadth is defined as a distance from the leading edge to the trailing edge.

19. The putter head of claim 16, wherein the first hollow cavity in the heel portion has a greater volume than the second hollow cavity in the toe portion.

* * * * *